US006289834B1

(12) United States Patent
Phillips

(10) Patent No.: US 6,289,834 B1
(45) Date of Patent: Sep. 18, 2001

(54) RAIN AND SUN SHIELDING COLLAPSIBLE VENTILATOR

(76) Inventor: Stephen Phillips, 433 Los Altos Dr., Aptos, CA (US) 95003

( * ) Notice: Subject to any disclaimer, the term of this patent is extended or adjusted under 35 U.S.C. 154(b) by 0 days.

(21) Appl. No.: 09/626,704

(22) Filed: Jul. 27, 2000

(51) Int. Cl.[7] ..... B63J 2/00

(52) U.S. Cl. ..... 114/211; 454/78; 454/81; 454/82

(58) Field of Search ..... 114/211, 212, 114/361, 177; 454/78, 81, 82; 135/88.01, 90, 121, 124, 135

(56) References Cited

U.S. PATENT DOCUMENTS

| | | | | |
|---|---|---|---|---|
| 1,256,281 | * | 2/1918 | Ahern | 454/81 |
| 3,757,664 | * | 9/1973 | Jalbert | 114/211 |
| 4,434,740 | * | 3/1984 | Childs | 114/211 |
| 4,608,915 | * | 9/1986 | Chatlos | 454/78 |
| 4,719,934 | * | 1/1988 | Mydans | 135/90 |
| 4,759,271 | * | 7/1988 | Bliemeister | 114/211 |
| 5,022,339 | * | 6/1991 | Baskin | 114/211 |
| 5,327,846 | * | 7/1994 | Androus | 114/211 |
| 5,339,759 | * | 8/1994 | Peabody | 114/211 |
| 5,588,386 | * | 12/1996 | Schilt | 114/211 |
| 6,178,908 | * | 1/2001 | Stolzenberger | 114/211 |

* cited by examiner

*Primary Examiner*—S. Joseph Morano
*Assistant Examiner*—Lars A. Olson
(74) *Attorney, Agent, or Firm*—Jeffrey A. Hall

(57) ABSTRACT

A portable collapsible ventilator that is used to direct air currents into a boat hatch, recreational vehicle vent, or other opening in an enclosed space while, at the same time shielding that opening from the intrusion of rain and direct sunlight. The ventilator has a frame of hinged, flexible rods covered with a water repellent fabric with an opening at one end. The ventilator is erected into a freestanding unit by pushing down on the hinge point of the flexible rods and locking them in position with a locking mechanism to form a semi-circular shape. A rod is inserted between the front and center hinge points to extend the open end of the device forward into a rain and sun shielding position. The ventilator is then positioned over the opening to be ventilated and secured in place with attached shock cords. When not in use, the ventilator is collapsed into an elongated shape with the flexible rods aligned and the cover folded around them to enable insertion into a storage bag.

12 Claims, 3 Drawing Sheets

RAIN AND SUN SHIELDING COLLAPSIBLE VENTILATOR

BACKGROUND OF THE INVENTION

1. Field of Invention

This invention relates to portable collapsible devices used to direct breeze into a boat hatch, recreational vehicle vent or other opening while, at the same time shielding that opening from the intrusion of rain and sunlight.

2. Description of the Related Art

Heretofore a wide variety of ventilation devices have been proposed and implemented. Ventilation of small enclosed spaces such as sailboat and powerboat cabins, recreational vehicles such as camper shells, trailers, and motorhomes, and other similar confined areas is desired for the comfort of the occupants. The need is magnified in warm humid weather where the reduction in evaporative cooling caused by high humidity can be offset by increased airflow.

Another concern in areas of high humidity is the frequency of passing rain showers, particularly at night on or near large bodies of water. A restful night's sleep in the cabin of a sailboat or motor cruiser is often interrupted by the need to first close ventilating hatches when a rain shower begins and then reopen them again after the shower passes.

During the day, there is also a need for shading open or transparent hatch covers and other openings from direct sunlight. The intrusion of sunlight can significantly raise the interior temperature of a small cabin or other enclosed space by a substantial amount.

Prior attempts to address such issues have met with limited success. For example, wind scoop type devices have been disclosed that capture breezes and direct them into the cabin space. Such devices have been designed specifically for sailing vessels, which have rigging above decks available to support the device while being used, for example in U.S. Pat. No. 5,327,846 issued to Androus. Another genre of device are those using permanent fixtures which require a special through-deck opening, U.S. Pat. No. 4,535,715 issued to McIntosh, or depend on special fittings to attach them directly to the hatch opening, U.S. Pat. No. 5,022,217 issued to Baskin. Others must be individually sized to fit particular hatches, for example, U.S. Pat. No. 5,022,740 issued to Childs, and U.S. Pat. No. 4,759,271 issued to Bliemeister. Some devices, while directing breezes do nothing to prevent rain or sunlight from entering the ventilated opening, such as U.S. Pat. No. 4,706,593 issued to Vail, U.S. Pat. No. 4,938,123 issued to Hilton, and U.S. Pat. No. 5,588,386 issued to Schilts.

Accordingly, it is the primary object of this invention to provide a ventilator for enhanced airflow to the confined spaces of marine vessels, recreation vehicles, and other related applications as well as to shield the ventilation opening from moisture intrusion and sunlight. The ventilation device of the present invention is useful and may be configured with a wide variety of opening sizes, is very easy to use, is quiet and efficient in operation, is very durable, and inexpensive to manufacture.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF SUMMARY OF THE INVENTION

To achieve the foregoing objects, and in accordance with the purpose of the invention as embodied and broadly described herein, a portable collapsible ventilator is provided that directs air currents into a boat hatch, recreational vehicle vent, or other opening in an enclosed space while, at the same time shielding that opening from the intrusion of rain and direct sunlight. The ventilator has a frame of hinged, flexible rods covered with a water repellent fabric with an opening at one end. The ventilator is erected into a freestanding unit by pushing down on the hinge points of the flexible rods and locking them in position with a locking mechanism to form a semi-circular shape. A rod is inserted between the front and center hinge points to extend the open end of the device forward into a rain and sun shielding position. The ventilator is then positioned over the opening to be ventilated and secured in place with attached shock cords. When not in use, the ventilator is collapsed into an elongated shape with the flexible rods aligned and the cover folded around them to enable insertion into a storage bag.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DETAILED DESCRIPTION OF THE INVENTION

Reference will now be made in detail to the present preferred embodiments of the invention as illustrated in the accompanying drawings.

In accordance with the present invention, there is provided a portable ventilating device for directing air flow into an opening of an enclosed space while sheltering the opening from the intrusion of rain and direct sunlight. The ventilator has a collapsible frame and locking means for securing and positioning the collapsible frame in an erect position over the opening. Hinge locking means are secured to the collapsible frame and a cover is affixed to the collapsible frame, with the cover having a forward extending portion and a central enclosing portion. A front assembly means for securing and positioning a front extension portion of the frame over the opening for protection against the intrusion of rain and direct sunlight into the open space and is secured to the frame.

There is also provided, in accordance with the invention, a ventilating device for directing airflow into an opening in a boat hull, having a collapsible frame and locking and positioning means for locking and securing the collapsible frame in an erect position over the opening of the boat hull. A durable and resilient cover is affixed to the frame. The cover preferably has a forward extending portion and a central enclosing portion. A front positioning assembly means is provided for securing and positioning the forward extending portion of the cover by holding one or more rods in a forward extending position over the opening in the boat hull.

Figure 1:
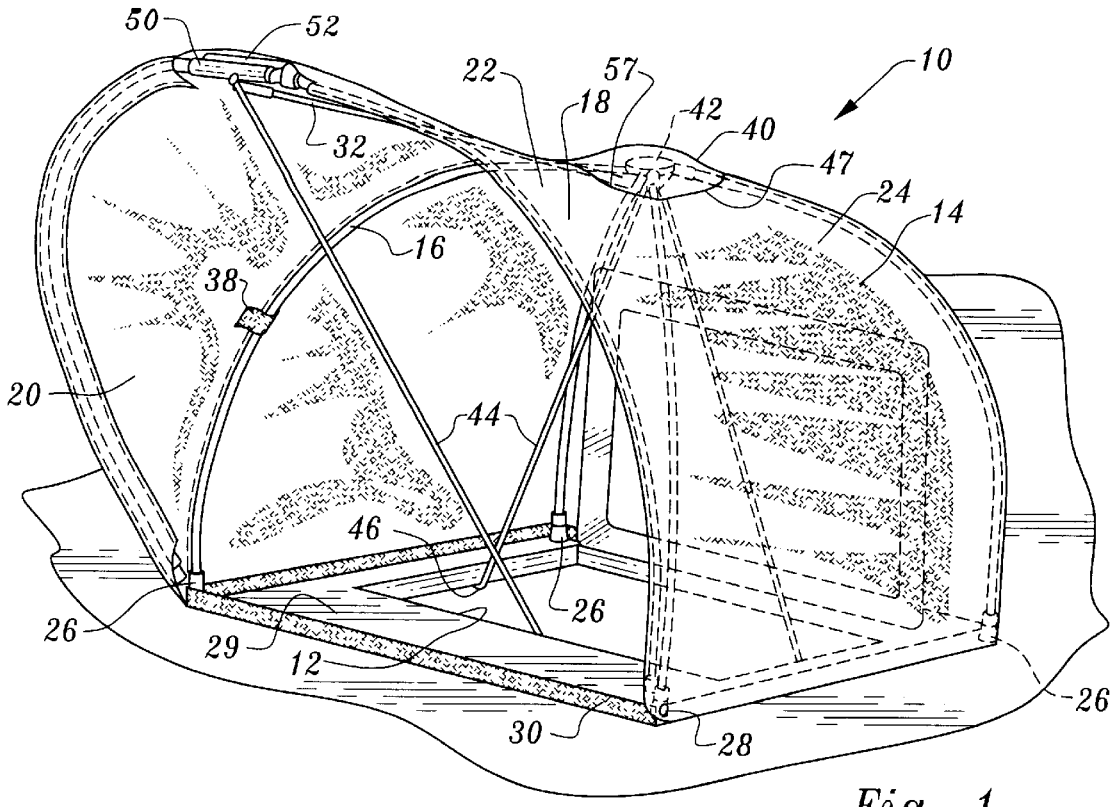
FIG. 1 is a perspective view of the ventilator in operating mode secured to an open hatch, according to the invention.

In FIG. 1, the rain and sun shielding collapsible ventilator 10 is shown directly positioned over a boat hatch 12, or other opening to be ventilated. Alternatively, ventilator 10 may be positioned on any flat surface. A cover 14 fits snugly to frame 16 when it is in the operating position forming a scoop shape 18 that is wider at opening 20, and curves downward 22, at rear 24, to direct a large volume of air through hatch opening 12. Cover 14 is preferably attached directly to rubber tipped feet 26, by corrosion resistant fasteners 28. Preferably there are four rubber tipped feet 26 provided for frame 16.

In the preferred embodiment, webbing 30 is used to reinforce base 29 of fabric cover 14, and also provides for control of front opening 20 width. A connecting rod 32 projects and locks front assembly 50, frame rods 55, and fabric cover 20 in a forward position to ensure opening 20 is shielded from moisture and the intrusion of sunlight. If desired, hook and loop fastening tape 38 may be used to secure cover 14 to the frame rods 36, two in the preferred embodiment, on the inside front of the ventilator 10.

An access cover 40 is folded back during set up of the ventilator to facilitate operation of the locking and positioning means. Cover 40 is then secured with hook and loop fasteners 47 during operation. The locking and positioning means, is preferably a central hinge element 42, with receptacles 43 for the ends of rods 36, and a fastening hub 51, best seen in FIGS. 4 and 4A. Receptacles 43 may be configured as apertures, grooves, or other rod receiving opening. Center hinge 42 preferably has a generally planar portion and is composed of a durable, flexible material.

Figure 2:
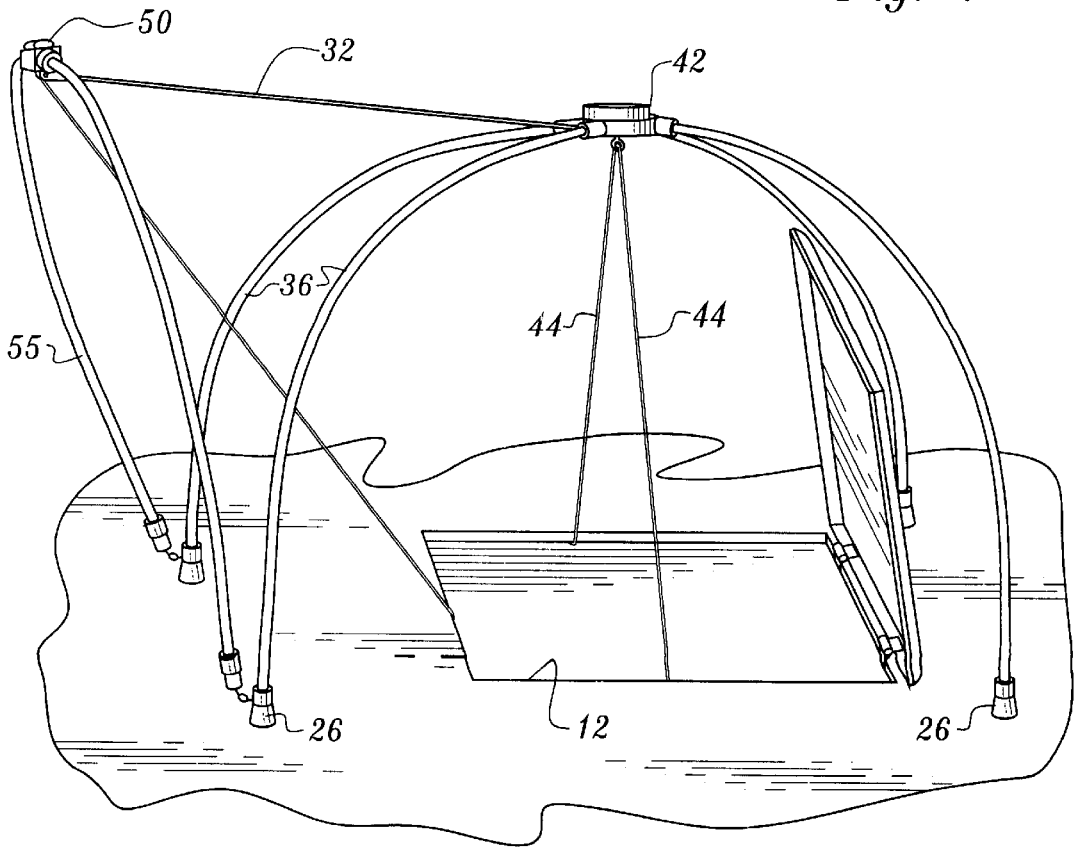
FIG. 2 is a perspective view of the frame of such ventilator, with the cover removed to shwo details, according to the invention.
Figure 3:
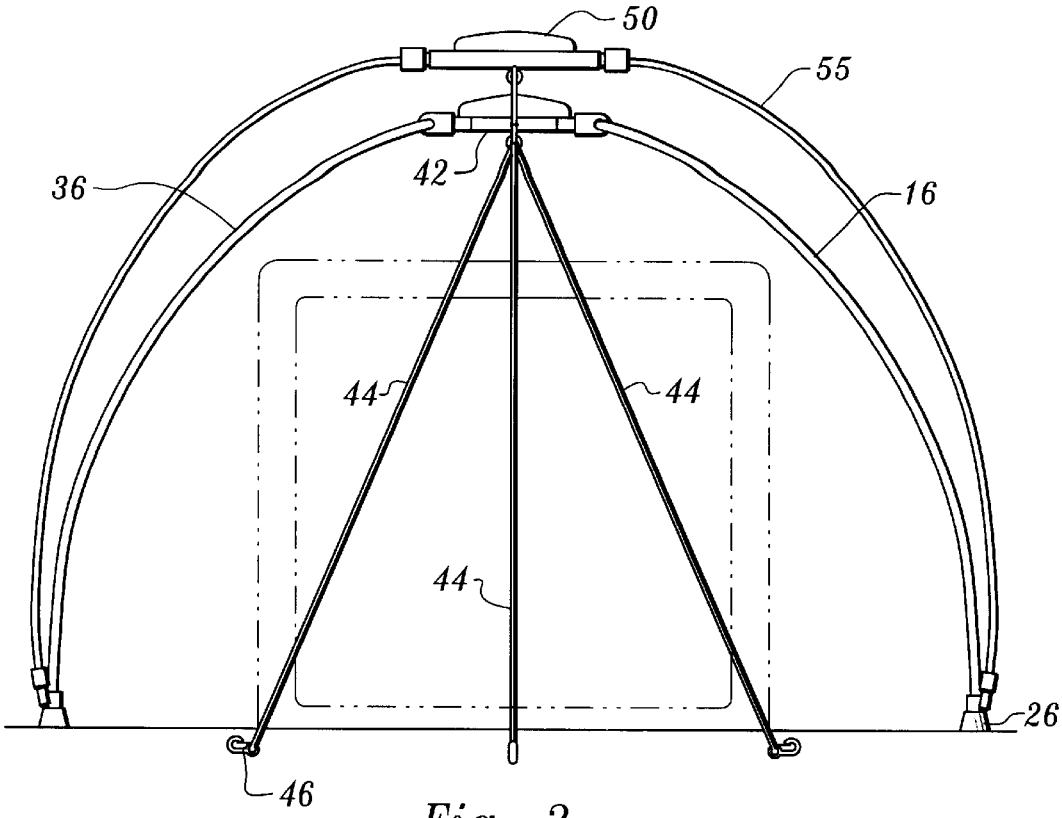
FIG. 3 is a front view of the frame in erect position, according to the invention.

One or more shock cords 44 with attached hooks 46, best seen in FIGS. 2 and 3, are preferably used to secure ventilator 10 to hatch 12 or other opening during use. Shock cords 44 allow the hatch to be closed if needed for security or high wind conditions when ventilator 10 is in use.

Figure 4:
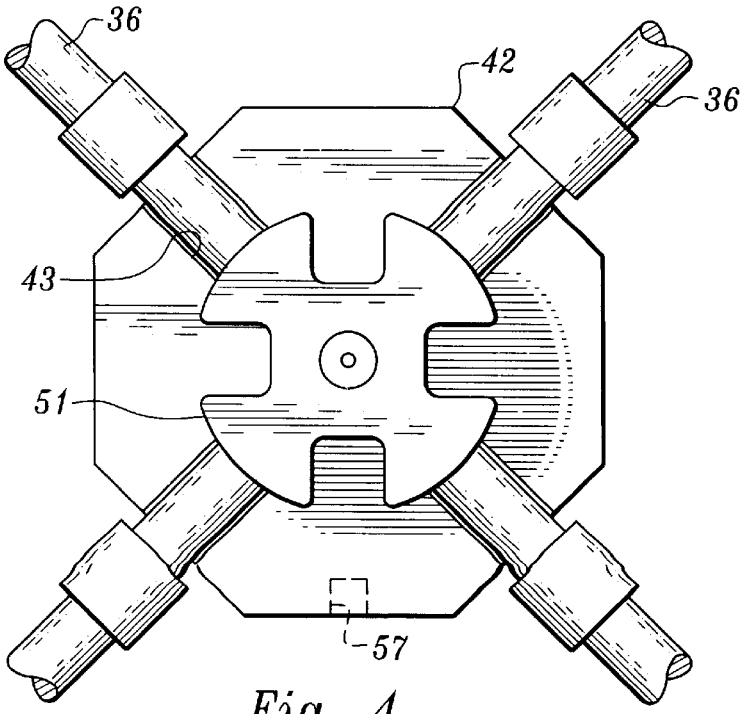
FIG. 4 is a detailed view of the center hinge locking and securing mechanism in a locked position, according to the invention.
Figure 4A:
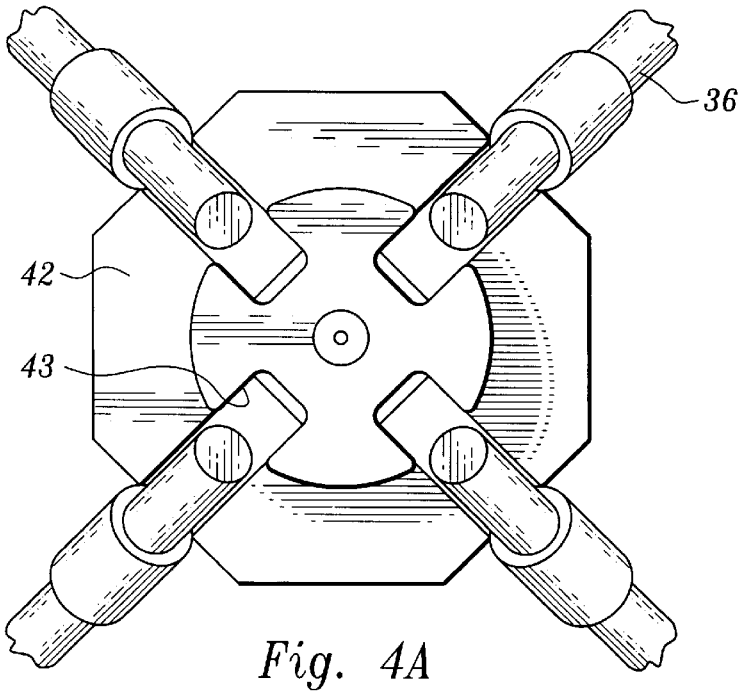
FIG. 4A is a detailed view of the center hinge locking and securing mechanism in an unlocked position, according to the invention.

In operation and use setting up ventilator 10 is very easy and requires only a few simple steps. Rubber tipped feet 26 are first spread apart as far as cover 14 permits. Next, the user pushes straight down on central hinge element 42 making sure that the four flexible rods 36 bow outward as seen in FIG. 2. Once the four rod tips of flexible rods 36 are positioned in the central hinge element 42, as seen in FIGS. 4 and 4A, fastening hub 51 is turned in either direction to lock the rod tips in a horizontal position.

Figure 5:
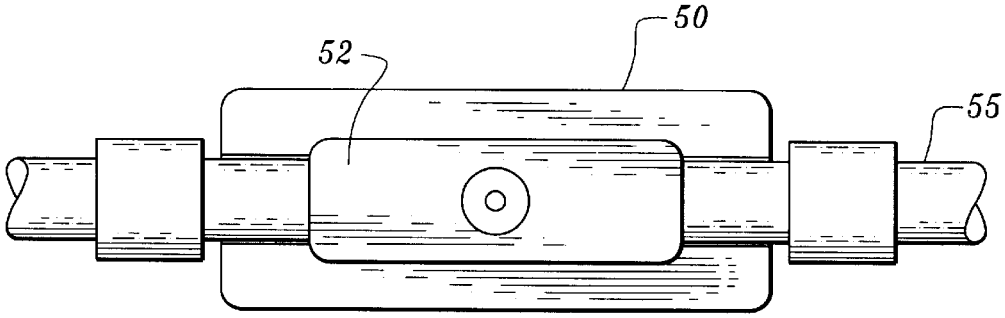
FIG. 5 is a detailed view of the front hinge assembly in the locked position, according to the invention.
Figure 5A:
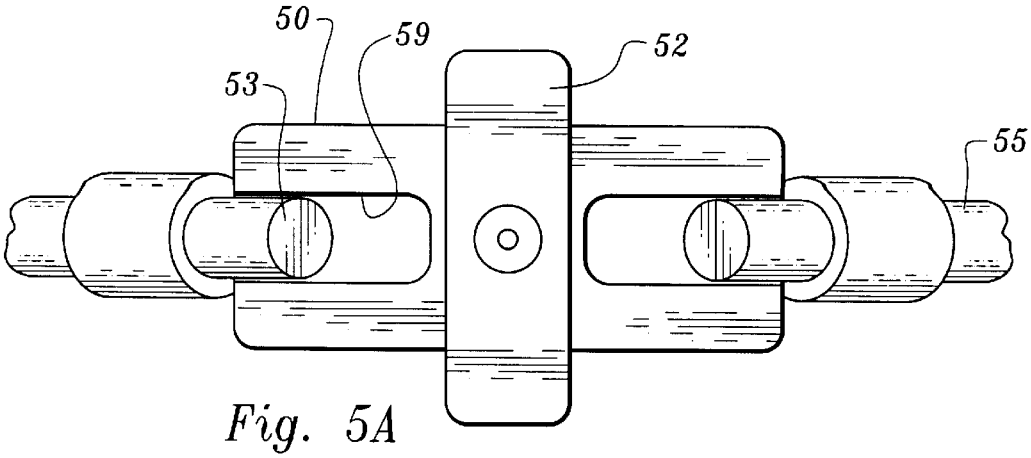
FIG. 5A is a detailed view of the front hinge assembly in an unlocked position, according to the invention.

Preferably, the user then pushes down on front positioning assembly means, preferably hinge assembly 50, best seen in FIGS. 5 and 5A, making sure that the tips of flexible rods 55 are in the horizontal position in slots or apertures 59. Then the locking hub 52 is rotated to secure the rod tips 53 in position. Hinge assembly 50 is shown in FIGS. 5 and 5A in a generally rectangular configuration, however, other configurations may be substituted if desired, such as round, oval, square etc. Connecting rod 32, which is attached to front hinge assembly 50 and to the central hinge 42 is then moved so as to insert the tip of connecting rod 32 in aperture 57 in the forward face of central hinge block 42, best seen in FIG. 1. Access cover 40 can be repositioned over the top of center hinge 42 and secured with hook and loop fasteners 40.

Ventilator 10 can then be positioned over hatch 12 or other opening facing into the wind and be secured to the opening with shock cords 44 and hooks 46 attached to the underside of center hinge 42 and front hinge assembly 50. A frontal view of frame 16 is seen in FIG. 3.

For storage and transport, ventilator 10, folds into a compact vertical configuration with feet 26 coming together, and front hinge assembly 50 and flexible rods 55 folding back to contact center hinge 42. Cover 14 folds around flexible rods 36 and 55 for insertion of the ventilator into a storage bag.

Ventilator 10 is preferably configured to form a large semicircular scoop so as to catch any available air movement and direct it into boat hatch 12, or other opening into an enclosed space. Ventilator 10 is rigid in its erect position so cover 14 remains stable and quiet during use.

Opening 20, is positioned in ventilator 10 so as to lean outward or forwardly, away from hatch 12 or other opening, and shields opening 20 from moisture due to rain, mist, dew, or from direct sunlight. Further ventilator 10 may be positioned so that hatch opening 12 is at the furthest point from opening 20.

Although completely collapsible into a small diameter elongated shape for storage, ventilator 10 is erected and locked into operating position in a completely freestanding mode through central hinge 42 and front positioning assembly 50. Accordingly, ventilator 10 is easily erected by one person in an area near the opening to be ventilated, then moved into position and adjusted to face the wind before being secured to the opening. This freestanding capability also enables ventilator 10 to be moved from one opening to another without collapsing the device, and so enables other uses such as portable temporary shelter for pets, in-field testing equipment, and the like.

Ventilator 10 can be positioned to face in any direction to optimize the flow of air into hatch 12 or other opening. This is particularly useful for boats which are not pointing directly into the prevailing wind, as may be the case in a marina slip, on a fore and aft mooring, or on bow and stern anchors. This feature also improves ventilation for motor homes or other recreational vehicles that have directionally fixed ventilation hatches.

As rods 36 are fitted with rubber feet 26 which come in contact with the deck surrounding hatch 12 or other opening, this protects the deck from scratches and also helps prevent ventilator 10 from moving while in use. Tightening shock cords 44 applies pressure to rubber tipped feet 26, increasing friction against the deck surface, thereby ensuring stability in even moderate winds. In the event of stronger winds, when ventilation is not desired, hatch 12 may be closed while ventilator 10 is still in operating position by simply stretching shock cord 44 around the sides of hatch 12. This also allows the user to secure the boat or recreational vehicle against intrusion without having to remove and stow ventilator 10 when leaving the boat or vehicle unoccupied.

As is evident from the above description, a wide variety of ventilating devices may be envisioned premised on the embodiments described herein and additional advantages and modifications will readily occur to those skilled in the art. For example, various sizes of ventilator may used to fit different openings, or, various types of covers or rods used. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A portable ventilating device for directing air flow into an opening of an enclosed space while sheltering the opening from the intrusion of rain and direct sunlight, comprising:

a collapsible frame;

hinge locking means for securing and positioning said collapsible frame in an erect position over said opening, said hinge locking means being secured to said collapsible frame;

a cover affixed to said collapsible frame, said cover having a forward extending portion and a central enclosing portion; and front assembly means for securing and positioning a front extension portion of said frame over said opening for protection against the intrusion of rain and direct sunlight into the open space, said front assembly means being secured to said frame.

2. The portable ventilating device of claim 1, wherein said collapsible frame comprises a plurality of hinged flexible rods.

3. The portable ventilating device of claim 2, wherein said hinge locking means comprise a hinge locking hub, said hinge locking hub having means for securing said plurality of hinged flexible rods in operable position therein.

4. The portable ventilating device of claim 1, wherein said front assembly means for securing a front extension portion of said frame comprises a rod positioning element and a locking element.

5. The portable ventilating device of claim 1, wherein said cover positioned on said collapsible frame is wider at an end forming an opening and curves downward at a rear portion, so as to facilitate and direct a large volume of air through said opening.

6. The portable ventilating device of claim 1, further including one or more shock cords and shock cord attachment means for operably securing said shock cords to said collapsible frame.

7. A portable ventilating device for directing airflow into an opening in a boat hull, comprising:

a collapsible frame;

locking and positioning means for locking and securing said collapsible frame in an erect position over said opening of said boat hull;

a durable and resilient cover affixed to said collapsible frame, said cover having a forward extending portion and a central enclosing portion; and a front positioning assembly means for securing and positioning said forward extending portion of said cover by holding one or more rods in a forward extending position over the opening in the boat hull.

8. The portable ventilating device of claim 7, wherein said collapsible frame comprises a plurality of hinged flexible rods.

9. The portable ventilating device of claim 8, wherein said locking and positioning means comprises a locking hub, said locking hub having means for securing said plurality of hinged flexible rods in operable position therein.

10. The portable ventilating device of claim 7, wherein said front positioning assembly means for securing a forward extending portion of said frame comprises a rod positioning element and a locking element.

11. The portable ventilating device of claim 7, wherein said durable and resilient cover positioned on said collapsible frame is wider at an end forming an opening and curves downward at a rear portion, so as to facilitate and direct a large volume of air through said opening.

12. The portable ventilating device of claim 7, further including one or more shock cords and shock cord attachment means for operably securing said shock cords to said collapsible frame and to position and secure the portable ventilating device over said opening in said boat hull.

* * * * *